US005226556A

United States Patent [19]

Lu

[11] Patent Number: 5,226,556

[45] Date of Patent: Jul. 13, 1993

[54] CASE

[76] Inventor: Jeng L. Lu, 138, Jau-Yang St., Chia-Yi City, Taiwan

[21] Appl. No.: 970,791

[22] Filed: Nov. 3, 1992

[51] Int. Cl.[5] ..... B65D 25/00

[52] U.S. Cl. ..... 220/445; 220/431; 220/469

[58] Field of Search ..... 220/445, 408, 427, 431, 220/469

[56] References Cited

U.S. PATENT DOCUMENTS

| | | | |
|---|---|---|---|
| 2,944,694 | 7/1960 | Kinsey | 220/408 X |
| 3,365,092 | 1/1968 | Blessing | 220/469 X |
| 3,445,050 | 5/1969 | Peters et al. | 220/445 X |
| 3,465,873 | 9/1969 | Munz | 220/427 X |
| 3,805,018 | 4/1974 | Luong et al. | 220/427 X |
| 4,134,518 | 1/1979 | Menchen | 220/431 |

*Primary Examiner*—Steven M. Pollard

*Attorney, Agent, or Firm*—Jacobson, Price, Holman & Stern

[57] ABSTRACT

A case having an inner case and an outer case combined together by means of a flange and a low wall extending rearward from the flange provided around an open front side of the inner case and a projecting ridge having a low notch in an outer end on each inner surface of four continuous sides of the outer case, the projecting wall of the flange engaging and being glued with the projecting ridges of the outer case to combine the inner and the outer case to form a complete case.

1 Claim, 2 Drawing Sheets

CASE

BACKGROUND OF THE INVENTION

Conventional cases are generally made of wood and combined together with nails, and speed of their manufacture is slow, to a resultant high cost. Cases made of plastic shown in FIG. 4 are made of a long plastic plate cut with V-shaped grooves B, then folded up and glued together with connectors C, forming a complete case. Though this plastic case can be made quicker than wooden cases, and its material is easy to get, it needs adhesive process, which slows down manufacturing speed. Even if it is made by ejecting process, it still takes time to let it cool down for taking it off a mold, as it has a thick wall, not a hollow one, having heavy weight.

SUMMARY OF THE INVENTION

The object of this invention is to provide a case having an inner case and an outer case wherein the inner case is deposited. Both cases are made of plastic by means of ejecting process, so speed of their manufacture can be very quick.

The inner case has four continuous sides - an upper, a bottom, a right and a left one, a closed rear side, an open front side, and a flange provided around the open front side with a low wall extending rearward from the flange in parallel to the four sides.

The outer case also has four continuous sides, an open front side, an open rear side with a low circumferential wall to surround the rear side of the inner case when the inner case is deposited in the outer case, and a projecting ridge on an inner surface of each of the four continuous sides. Each ridge has a lower notch at its front end for each low wall of the flange of the inner case to engage with and glued together with adhesive or by high frequency process to combine the inner case and the outer case together to become a complete case.

DETAILED DESCRIPTION OF THE INVENTION

Figure 1:
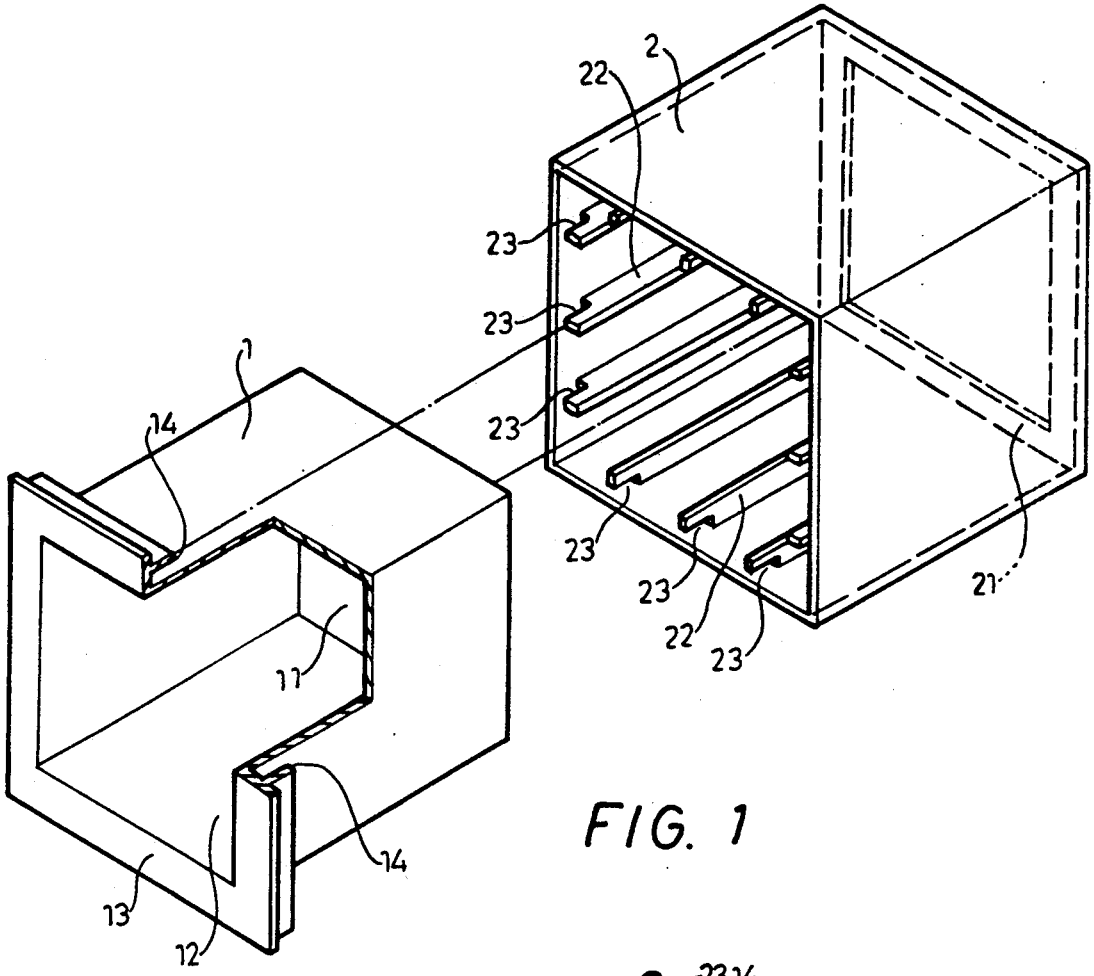
FIG. 1 is an exploded perspective view of a case in the present invention.

A case in the present invention, as shown in FIG. 1, is made of plastic by means of ejecting process, comprising an inner case 1 and an outer case 2.

The inner case 1 is hollow, having a square or rectangular cross-section, four continuous sides—an upper, a bottom, a right and a left one, a closed rear side 11, and an open front side 12, through which things pass through to be put therein. A flange 13 is provided to surround the open front side 12, having the same height and width as those of the outer case 2 to contact with a circumferential edge of a front side of the outer case 2. A low wall 14 is provided extending rearward from the flange 13 in parallel to the four sides, being in contact with the inner surface of the outer case 2.

Figure 2:
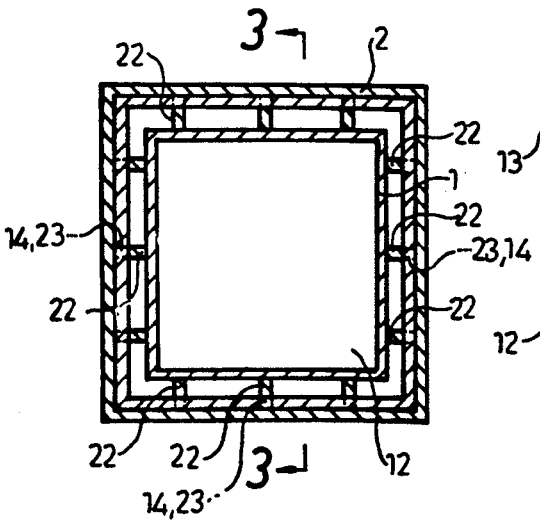
FIG. 2 is a cross-sectional view taken along line 2—2 of FIG. 3.
Figure 3:
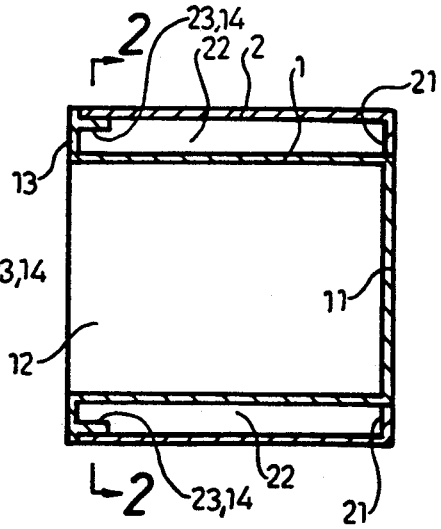
FIG. 3 is a cross-sectional view taken along line 3—3 of FIG. 2.
Figure 4:
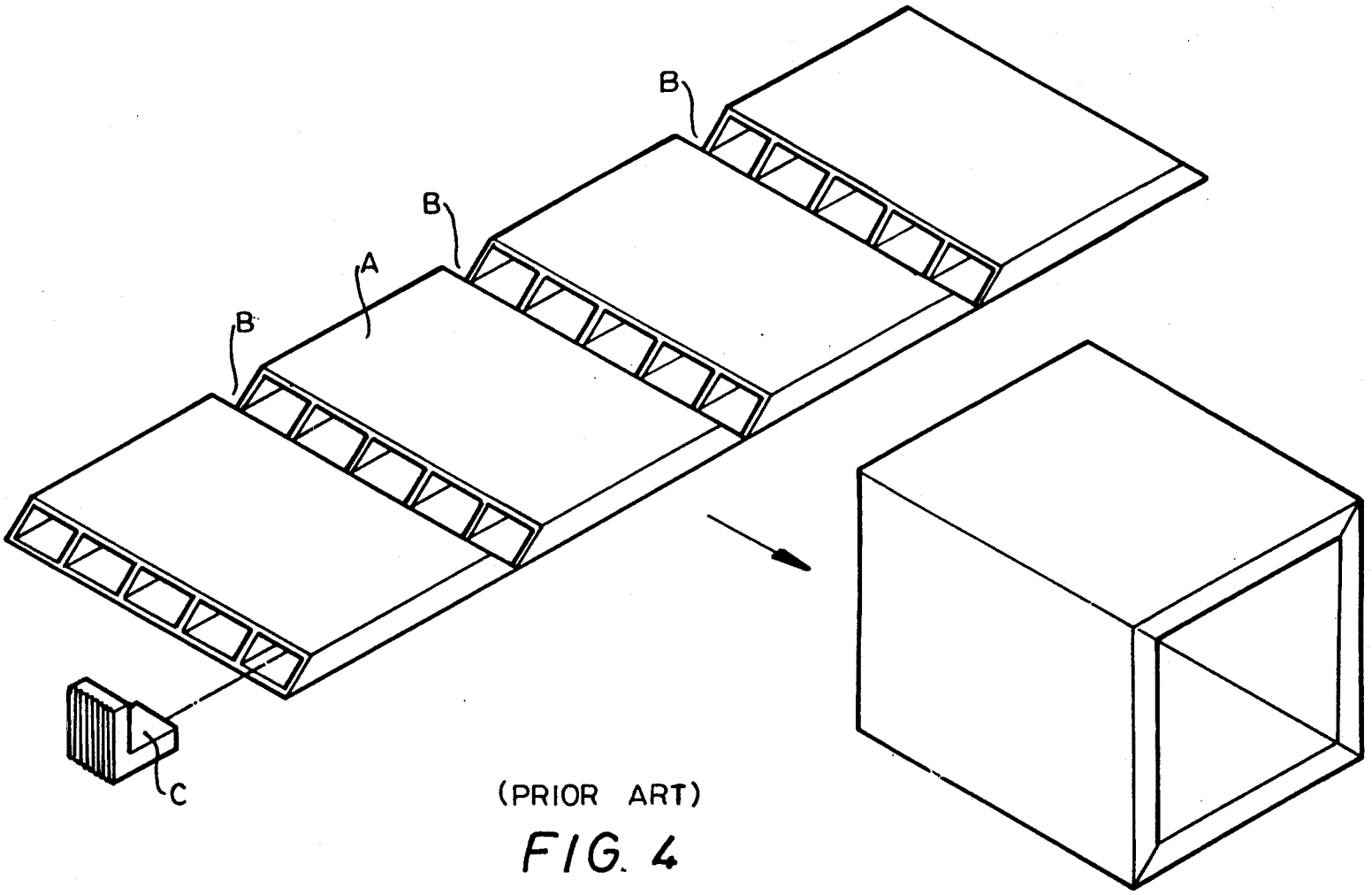
(PRIOR ART) FIG. 4
FIG. 4 is a structural view of a conventional case.

The outer case 2 is made of plastic by means of ejecting process, having almost the same shape as the inner case 1, four continuous sides, and an open front side, an open rear side with a circumferential low wall 21 to surround the rear side of the inner case when the inner case 1 is combined with the outer case 2. The inner case 1 can be pushed through the open front side and deposited in the outer case 2 with its rear side 11 fitting in the opening surrounded by the circumferential low wall 21. The outer case 2 also has a projecting straight ridge 22 on an inner surface of each continuous side, and each ridge 22 has a lower notch 23 in an outer end for the low wall 14 of the inner case 1 to engage tightly after the inner case 1 is deposited in the outer case 2. Then the both, the low wall 14 and the ridges 22 are glued together with adhesive or by high frequency process, as shown in FIGS. 2 and 3.

The structure of the case in the present invention is very simple and convenient for manufacture, possible to be shaped square, rectangular, round, etc. and to save material more than half of the conventional case.

What is claimed is:

1. A case comprising;

an inner case made of plastic by means of ejecting process, having four continuous sides - an upper, a bottom, a right, and a left one, a closed rear side, and an open front side surrounded with a flange having the same height and the same width as an outer case, and a low wall extending rearward from the flange and parallel to the four continuous sides;

an outer case having almost the same shape as the inner case, four continuous sides - an upper, a bottom, a right and a left one, an open front side, an open rear side with a low circumferential wall to surround the rear side of the inner case, said open front side being passed through by the inner case, which is then deposited in the outer case, said four continuous sides respectively provided with a projecting straight ridge on its inner surface, each said ridge having a lower notch at an outer end for the low wall of the flange in the inner case to engage with and combined together with adhesive or by high frequency after the inner and the outer case are combined together to become a complete case.

* * * * *